US010981077B1

(12) United States Patent
Rolph et al.

(10) Patent No.: US 10,981,077 B1
(45) Date of Patent: Apr. 20, 2021

(54) RECONFIGURABLE INFANT PLAY MATS AND DISPLAYS

(71) Applicant: Lovevery, Inc., Boise, ID (US)

(72) Inventors: Jessica Thacher Crolick Rolph, Boise, ID (US); Roderick Neal Morris, Boise, ID (US); Seth Thomas Murray, Boise, ID (US)

(73) Assignee: Lovevery, Inc., Boise, ID (US)

( * ) Notice: Subject to any disclaimer, the term of this patent is extended or adjusted under 35 U.S.C. 154(b) by 0 days.

(21) Appl. No.: 16/673,325

(22) Filed: Nov. 4, 2019

Related U.S. Application Data

(63) Continuation of application No. 15/861,919, filed on Jan. 4, 2018, now Pat. No. 10,486,076, which is a continuation of application No. 15/722,418, filed on Oct. 2, 2017, now abandoned.

(51) Int. Cl.
*A63H 33/00* (2006.01)
*A47D 15/00* (2006.01)

(52) U.S. Cl.
CPC ..... *A63H 33/006* (2013.01); *A47D 15/003* (2013.01)

(58) Field of Classification Search
CPC ..... A63H 3/00; A63H 3/003; A63H 3/006; A63H 3/008; A63H 33/00; A63H 33/003; A63H 33/006; A63H 33/008; A47D 15/003; A63B 21/4037; A63B 2208/12
USPC ..... 446/227; 5/416, 417, 655; 135/96, 135
See application file for complete search history.

(56) References Cited

U.S. PATENT DOCUMENTS 2,078,022 A * 4/1937 Roemer ..... A63F 9/088 446/227
2,442,105 A * 5/1948 Vacheron ..... A47G 9/066 2/69.5
3,105,505 A * 10/1963 Maybee ..... E04H 15/001 135/135
5,035,013 A * 7/1991 Bloom ..... A47D 15/003 5/420
5,088,139 A * 2/1992 Bloom ..... A47D 13/063 190/1
D388,651 S 1/1998 Graebe
D408,192 S 4/1999 Chiang
6,702,643 B1 * 3/2004 Drosendahl ..... A63H 33/006 446/175
6,785,921 B1 * 9/2004 Conforti ..... A47D 5/00 5/655
7,117,552 B2 * 10/2006 Hoffman ..... A47D 13/06 5/655
7,290,303 B2 * 11/2007 Mead ..... A47D 13/08 5/640

(Continued)

*Primary Examiner* — Alexander R Niconovich
(74) *Attorney, Agent, or Firm* — Fish & Richardson P.C.

(57) ABSTRACT

An infant play mat with a flexible central mat portion having a fabric surface that forms a first infant play area including multiple flexible flaps. The infant play mat has a polygonal perimeter with multiple straight edges, with two of the edges defining a corner therebetween. Multiple flexible flaps extend from a respective one of the perimeter edges and define a fold line. Each flap has an upper flap surface exposed when the flap is extended, and hidden when the play mat is folded at the fold line to cover a region of the central mat portion. The central mat portion and lower surfaces of the flaps together form a second infant play area when the play mat is folded at all of the fold lines.

19 Claims, 4 Drawing Sheets

(56) References Cited

U.S. PATENT DOCUMENTS 7,302,724 B2 * 12/2007 Solomon ..... A47D 15/003 5/417
7,490,379 B2 * 2/2009 Solomon ..... A47D 15/003 5/417
7,520,010 B2 * 4/2009 Welch ..... A47D 5/006 190/1
D597,357 S 8/2009 Stewart
7,621,235 B2 * 11/2009 Genitrini ..... A01K 15/025 119/706
7,624,461 B2 * 12/2009 Tidwell ..... A47D 13/08 5/655
7,845,508 B2 * 12/2010 Rothschild ..... A45C 15/00 220/7
7,856,688 B2 * 12/2010 Dockendorf ..... A47D 13/08 5/655
8,460,053 B2 * 6/2013 Fair ..... B62B 9/26 446/227
8,616,932 B2 * 12/2013 Gelfond ..... E04H 15/48 446/227
8,968,048 B2 * 3/2015 Oren ..... A47D 13/00 446/227
9,011,196 B2 * 4/2015 Weisman ..... A63H 33/006 446/227
9,155,974 B2 * 10/2015 Fair ..... B62B 3/1456
9,821,240 B2 * 11/2017 Hansen ..... A63H 5/00
10,307,686 B2 * 6/2019 Bearsch ..... G03B 29/00
2003/0182724 A1 * 10/2003 Zheng ..... A63F 3/00533 5/413 R
2004/0266312 A1 * 12/2004 Oren ..... A47D 15/003 446/227
2007/0277321 A1 * 12/2007 Leach ..... A47D 15/003 5/655
2008/0050050 A1 * 2/2008 Seecof ..... A45F 4/02 383/4
2009/0021902 A1 * 1/2009 Zheng ..... A63H 33/008 361/679.01
2010/0144237 A1 * 6/2010 Wilkins ..... A47D 15/00 446/227
2010/0219221 A1 * 9/2010 Zheng ..... A45C 15/00 224/576
2012/0020586 A1 * 1/2012 Gilbert ..... A47D 15/003 383/4
2014/0194031 A1 * 7/2014 Tobias ..... A63H 33/006 446/227
2016/0101369 A1 * 4/2016 Austern ..... A63H 33/006 446/227
2017/0252662 A1 * 9/2017 Elson ..... A63H 33/008
2019/0099685 A1 4/2019 Rolph

* cited by examiner

RECONFIGURABLE INFANT PLAY MATS AND DISPLAYS

CROSS-REFERENCE TO RELATED APPLICATION

This application is a continuation application of and claims priority to U.S. application Ser. No. 15/861,919, filed on Jan. 4, 2018, which is a continuation application of and claims priority to U.S. application Ser. No. 15/722,418, filed on Oct. 2, 2017, now abandoned, the entirety of which are incorporated by reference into the present disclosure.

TECHNICAL FIELD

This invention relates to infant play mats and devices for presenting selectable focus and/or interaction graphics to infants.

BACKGROUND

Play mats provide soft surfaces on which an infant can be placed, usually on a floor, as a safe, clean environment, typically for the pre-crawling development stage. Some such mats carry graphics or other images that are designed to visually stimulate the infant when on his/her stomach. Some mats are used with a superstructure that extends over the infant, from which entertaining or educating/interactive objects may be suspended, for stimulating the infant when on his/her back. Improvements in the design and configuration of such mats, and other image displays for pre-crawling infant development, are continually sought.

SUMMARY

One aspect of the invention features an infant play mat with a flexible central mat portion and multiple flexible flaps. The infant play mat has a fabric surface that forms a first infant play area and has a polygonal perimeter that includes multiple straight edges, with two of the edges defining a corner between them. The multiple flexible flaps extend from a respective one of the central mat portion straight perimeter edges and define a fold line of reduced folding stiffness. Each flap has an upper flap surface exposed when the flap is extended to be co-planar with the central mat portion, and hidden when the play mat is folded at the fold line to cover a region of the central mat portion with the flap, exposing a lower surface of the flap. The lower surfaces of the flaps have fabric. The central mat portion and lower surfaces of the flaps together form a second infant play area when the play mat is folded at all of the fold lines. Two of the flaps extend from the two edges to define the corner and are shaped such that, when overlaying the central mat portion, the two flaps do not overlap.

In some embodiments, all of the flaps are shaped such that, with the play mat folded at all of the fold lines, none of the flaps overlap.

In some arrangements, the two flaps that extend from the two edges have outer edges that lie adjacent to one another with the two flaps that overlay the central mat portion. In some cases, the two flaps that extend from the two edges both extend to the corner.

In some examples, the infant play mat further includes an internal flap that extends from a fold line internal to the first infant play area that extends between two of the straight edges of the perimeter. In some cases, the infant play mat further includes a superstructure support leg that extends from a corner of the perimeter defined between the two straight edges bounding the internal fold line. The internal flap is of sufficient width to be propped against the support leg in an elevated flap position. In some examples, the internal flap has an outer edge that aligns with a portion of one of the straight edges of the periphery when the internal flap is in a folded position.

In some embodiments, the central mat portion carries an image boundary aligned with an outer edge of a flap with the play mat folded. In some cases, the boundary is of an image that extends from the boundary to an adjacent edge of the polygonal perimeter, such that the play mat is foldable to hide the image. In some cases, the central mat portion carries multiple image boundaries, each boundary aligned with an outer edge of a respective flap with the play mat folded.

In some examples, each of the multiple image boundaries bounds a visually different image that extends from the boundary to a respective adjacent edge of the polygonal perimeter.

In some embodiments, the infant play mat further includes a frame with legs that extend from corners of the perimeter of the central mat portion and connect at a point spaced above the central mat portion. In some embodiments, the infant play mat further includes at least one item suspended on a cord from the frame over the central mat portion. In some examples, the corners from which the legs extend define pockets into which ends of the frame are received to secure the frame ends to the central mat portion.

Another aspect of the invention features an infant play gym that includes a mat, a superstructure, a card holder, and a set of multiple visual stimulation cards. The mat has a fabric surface that forms an infant play area. The superstructure has multiple legs that extend upward from about the play area and are connected above the mat. The card holder has means to releasably hold a visual stimulation card in a non-horizontal position and in view of an infant lying in the infant play area. The set of multiple visual stimulation cards carry different two-dimensional visual stimulation graphics, and can be selectably and alternately attached to the card holder for display to an infant lying in the infant play area.

In some embodiments, the card holder includes a flap that extends from a fold line. The flap has an upper flap surface configured to carry one or more of the visual stimulation cards. The flap is movable between an open position in which the upper flap surface is in a non-horizontal position to expose an attached card, and a closed position in which the upper surface is folded against the fabric surface of the mat. In some embodiments, the fold line extends from one outer edge of the mat to another outer edge of the mat. In some examples, a first leg of the superstructure connects to the mat at a position outboard of the card holder flap. In some examples, the card holder flap is configured to engage and be supported by the first leg in its open position.

In some cases, the infant play gym further includes other flaps that extend from a perimeter edge of the mat. The other flaps are foldable between open positions with the other flaps extending outward from the mat, and closed positions with the other flaps overlying the mat.

In some arrangements, the card holder has a canopy that spans at least two legs of the superstructure, positioned for an infant on the mat to view.

In some embodiments, the means to releasably hold a visual stimulation card includes a transparent window that overlies a pocket sized to receive the stimulation card.

In some embodiments, the means to releasably hold a visual stimulation card includes two spaced-apart card edge clamps, each clamp positioned to engage a respective edge of a card placed between the clamps. In some examples, the clamps include buttons sewn to the card holder.

A play mat with card holders for swapping visual stimulation cards can promote an infant's cognitive development. Some experts believe that high contrast images held at about twelve inches from an infant's face can strengthen the connections between the infant's eyes and brain as the infant focuses on a card. A card holder for releasably holding cards can allow an adult to change the cards for more complex images. This can help retain the attention of the infant and allows the adult to increasingly stimulate the infant according to his/her development.

A play mat with foldable flaps can help strengthen an infant's body muscles by retaining the attention and entertaining an infant during exercises such as 'Tummy time,' prolonging and enhancing the infant's exercise experience. Foldable flaps can help an infant start to remember objects from one appearance to the next. For instance, when a flap with an object is folded inward, the infant can begin to remember which flap contains the object.

The details of one or more embodiments of the invention are set forth in the accompa-nying drawings and the description below. Other features, objects, and advantages of the invention will be apparent from the description and drawings, and from the claims.

DESCRIPTION OF DRAWINGS

FIG. 1A is a perspective view of a first infant play mat, with flaps folded in.

FIG. 2A is a top view of a second infant play mat, with flaps folded in.

Like reference symbols in the various drawings indicate like elements.

DETAILED DESCRIPTION

Figure 1A:
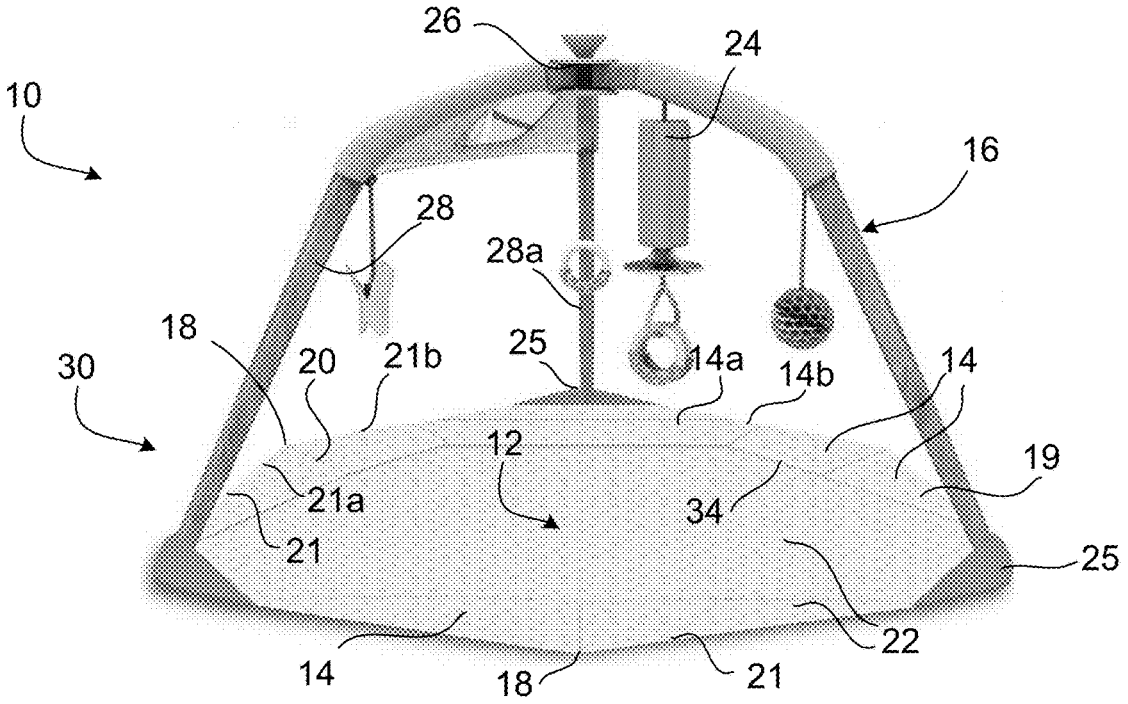
Figure 1B:
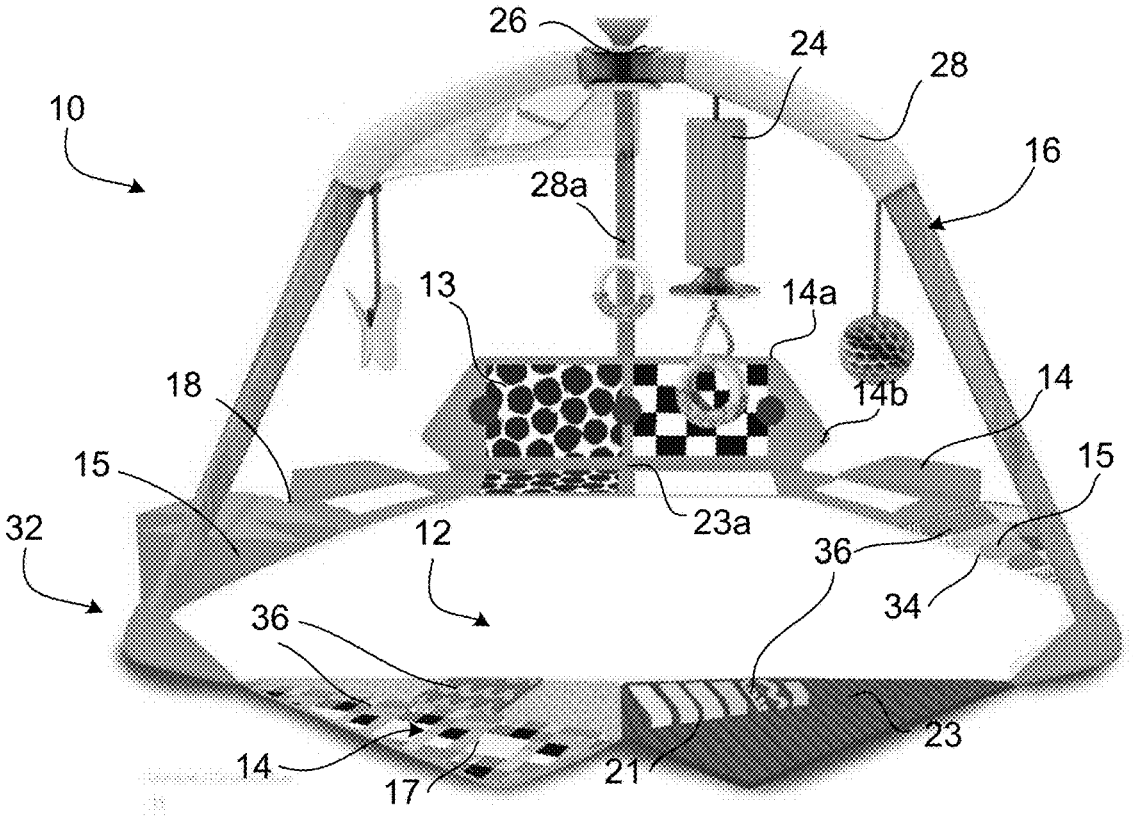
FIG. 1B is a perspective view of the infant play mat in FIG. 1A, with flaps folded out.

Referring to FIGS. 1A and 1B, an infant play mat 10 provides a soft surface for an infant to lay on. Infant play mat 10 is of sufficient size to support a six-month old infant. Infant play mat 10 includes a central mat portion 12, flaps 14, and a superstructure 16. Central mat portion 12 is made of a flexible material and has a fabric surface 22 with a polygonal perimeter (e.g., hexagonal) that includes multiple straight edges 21. Edges 21*a* and 21*b* meet at and together define a corner 18. Central mat portion 12 has an image boundary 34 (FIG. 1B) aligned with an outer edge of flaps 14 when the play mat is folded (FIG. 1A). Boundary 34 bounds images 36 that extend from the boundary to edges 21, such that images 36 are hidden when flaps 14 are folded inward as in FIG. 1A, but exposed when the flaps are folded outward. Flaps 14 are also made of a flexible material and have a fabric surface. Preferably, the back surface of the mat, including the central mat portion and the flaps, is of a single piece of cloth, stitched along the fold lines. The mat is constructed as two layers of cloth sandwiching a layer of padding so as to provide a soft, comfortable surface on which to lay an infant, particularly an infant not yet able to crawl. As shown in FIG. 1B, each flap 14 extends from a respective one of the straight edges 21, defining a fold line 23 between flap 14 and central mat portion 12. Each flap 14 has an upper flap surface 17 that is exposed when flap 14 is folded out (e.g., extended to be co-planar with central mat 12) and hidden when flap 14 is folded in, as shown in FIG. 1A. When a flap 14 is folded, flap 14 covers a region 15 of mat 12, exposing a lower surface 19 (FIG. 1A) made with fabric.

Superstructure 16 includes three support legs 28 that meet at a joint 26 and extend over mat 12. Preferably, support legs 28 are made of a strong but light material such as wood or PVC. Interactive objects 24 of different visual and tactile attributes suspend by cords from upper portions of the legs for entertaining an infant lying on the mat below. Legs 28 extend from respective corners 25 of the perimeter defined between edges 21. In some examples, the corners from which legs 28 extend define pockets into which ends of superstructure 16 are received to secure the superstructure ends to the central mat portion. An external support leg 28*a* connects to the mat outboard of an internal fold line 23*a* from which an internal flap 14*a* extends. Internal fold line 23*a* extends between two of the straight edges 21 of the perimeter and hinges internal flap 14*a*. External leg 28*a* allows internal flap 14*a* to be supported against external leg 28*a* in an elevated position (e.g., folded to extend out of the plane of the mat). Internal flap 14*a* is of sufficient length to lean against leg 28*a*, and includes an outer edge 14*b* that aligns with a portion of one of the straight edges 21, when the internal flap is folded in (as in FIG. 1A).

As shown in FIG. 1A, when flaps 14 are folded in, the play mat forms a first infant play area 30. As shown in FIG. 1B, when flaps 14 are folded out, the play mat forms a second infant play area 32, larger than the first area. In this example, at least two flaps 14 extend from two edges 21 that form a corner 18, with the flaps being shaped such that, when the play mat is folded at all of the fold lines (as in FIG. 1A), none of the flaps overlap. As shown in FIG. 1A, adjacent pairs of flaps 14 have outer edges 20 that extend from the corner 18 between the flaps and that lie adjacent to one another when folded in, overlaying central mat portion 12. Preferably, play mat 12 and flaps 14 are shaped such that, with the play mat folded at all of the fold lines 23, none of the flaps 14 overlap.

Upper surface 17 and regions 15 have images 36 for an infant to touch, see, and/or play with. Images 36 can include stimulation images and/or tactile surfaces for tactile stimulation. Internal flap 14*a* preferably includes transparent pockets for swapping images, as further discussed in FIGS. 3 and 4. Images 36 can be organized by stage-based learning zones, having, for example, different images on each flap to stimulate an infant according to his/her development stage. This configuration allows a parent to fold some flaps, leaving only selected flaps with images exposed to the infant according to the infant's development stage.

Figure 2A:
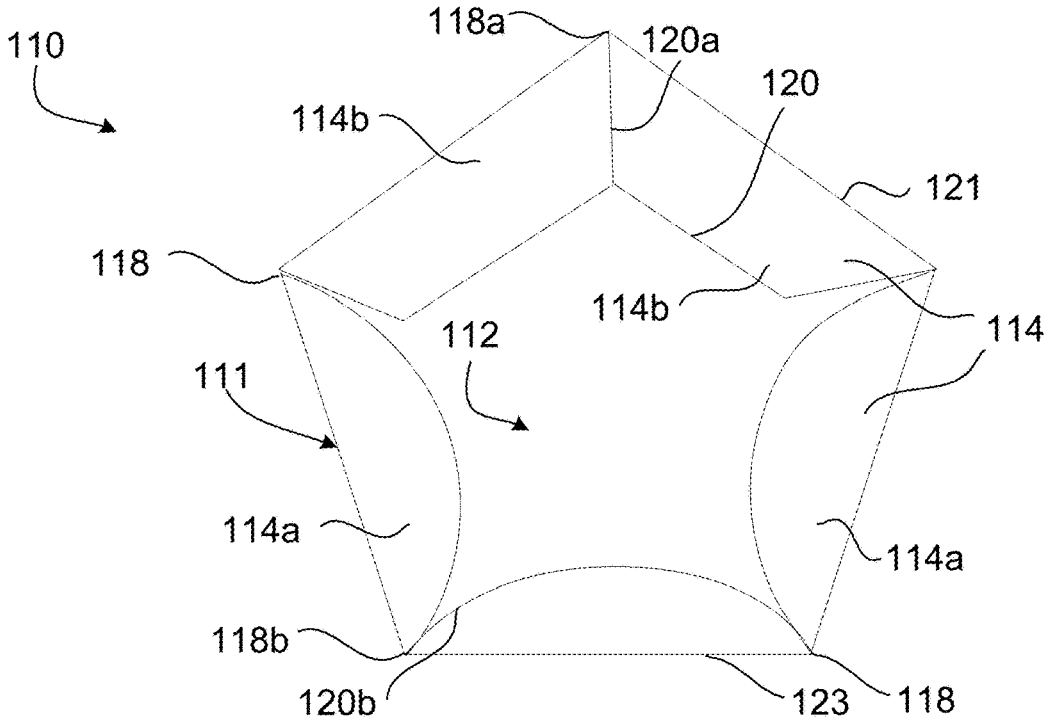
Figure 2B:
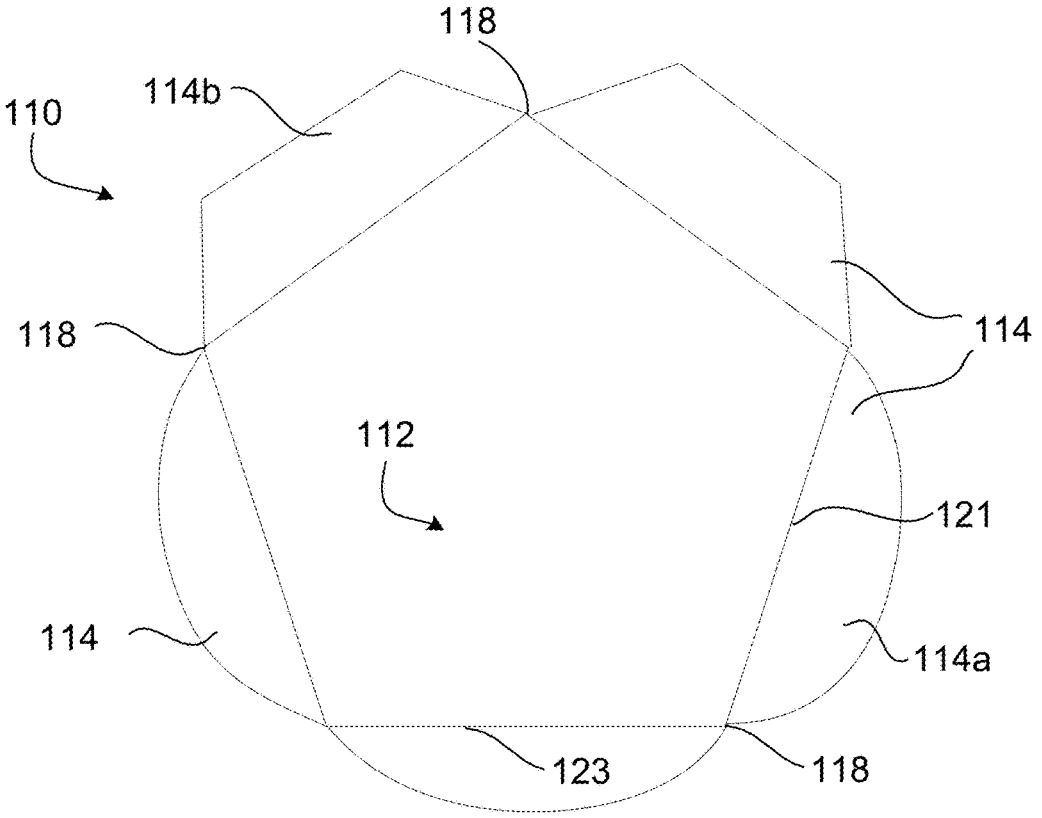
FIG. 2B is a top view of the infant play mat in FIG. 2A, with flaps folded out.

Referring to FIGS. 2A and 2B, a second infant play mat 110 is illustrated with a pentagonal perimeter 111. In this example, play mat 110 is shown without a superstructure. Pentagonal perimeter 111 has five straight edges 121 from which respective flaps extend. Play mat 110 is similar to play mat 10 in FIG. 1A, with the main differences being the shape of the perimeter and the shape of some of the flaps. Play mat 110 includes a central mat portion 112 and flaps 114. Play mat 110 includes rounded flaps 114*a* and regular flaps 114*b* with straight outer edges 120. Each flap 114 extends from a respective one of straight edges 121, defining a fold line 123.

Each of the five straight edges 121 of perimeter 111 meet at and together define respective corners 118. As shown in FIG. 2A, adjacent pairs of flaps 114*b* have outer edges 120*a* that extend from corner 118*a* between the flaps and that lie adjacent to one another when folded in, overlaying central mat portion 112. Similar to play mat 10 in FIG. 1A, flaps 114 are shaped such that, when play mat 110 is folded at all of the fold lines (as in FIG. 2A), none of the flaps overlap. Flaps 114 and the areas of the central mat portion 112 adjacent to the flaps also include images/graphics similar to play mat 10 (FIG. 1B).

Figure 3:
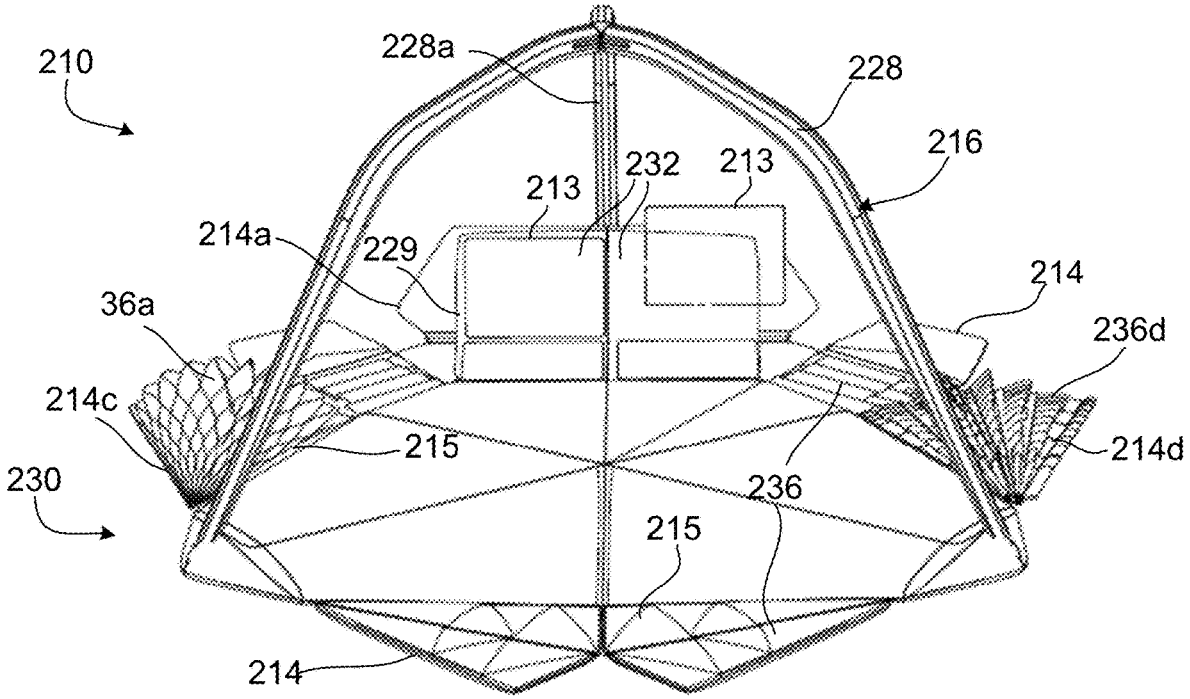
FIG. 3 is a perspective view of an infant play mat with a flap having transparent pockets.

Referring to FIG. 3, infant play mat 210 is similar to the one discussed above, but with different flap constructions and an internal flap with a card holder for releasably holding visual stimulation cards. In this example, the card holder includes a pair of windows 232 that define transparent flap pockets 229. Internal flap 214*a* is shown folded outward to lean against external leg 228*a* of superstructure 228 in an upright position. The transparent pockets 229 hold two-dimensional visual stimulation cards/graphics 213 in a non-horizontal position (e.g., non-horizontal with respect to the plane of the floor) and within sight of an infant lying on the infant play area 230. Cards 213 can be selectably and alternately swapped for display to an infant lying on infant play area 230. Each pocket 229 can hold a card 213 displaying a different image. Each window 232 has a flexible transparent surface (e.g., a transparent vinyl sheet) that is exposed for viewing contents of the pockets when flap 214*a* is in an upright position, and hidden when the flap is in a folded position (against the upper mat surface). Each window is bordered by compliant fabric frame sections. The vinyl sheet may be sewn to the frame backing or attached with an adhesive.

In some examples, internal flap 214*a* can be releasably attached to external leg 228*a* when folded upward. For instance, flap 214*a* may have a hook and loop connection on its back for attaching to leg 228*a*. In some examples, internal flap 214*a* has a cord extending from the back of flap 214*a* and of sufficient length to tie the flap to a support (e.g., leg 228*a*) in an upright position. In some examples, instead of transparent windows, flap 214*a* has open flap pockets. For example, flap 214*a* may have a frame without the transparent vinyl sheet, exposing the surface of cards 213 to the touch. In a further example, flap 214*a* can have a flip chart with multiple overlapping pockets for displaying cards 213.

Infant play mat 210 has flaps 214 of different properties. For example, a flap 214*c* extends a foldable honeycomb structure 36*a* when folded outward. A flap 214*d* has a flip chart 236*d* with different images/textures in each sheet of the flip chart. Each flap 214 and region 215 has a different stimulation surface or image 236.

Figure 4:
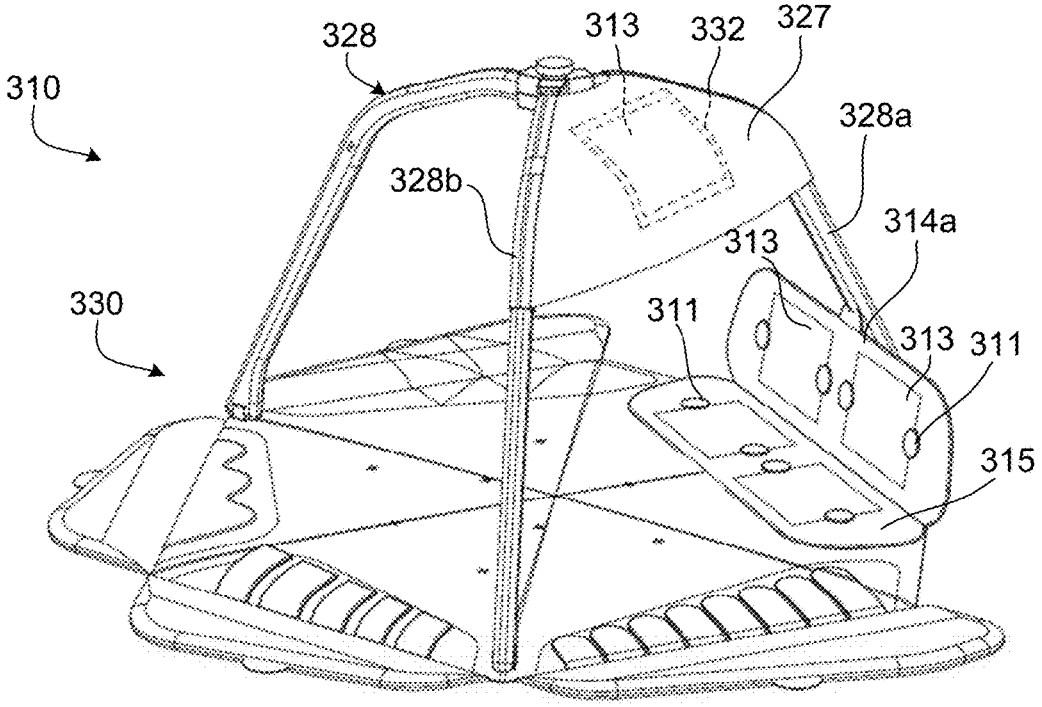
FIG. 4 is a perspective view of an infant play mat with different card holders.

Referring next to FIG. 4, infant play mat 310 is similar to the infant play mat of FIG. 3, with different configurations of card holders. In this example, internal flap 314*a* has buttons 311 distanced from one another to hold visual stimulation cards 313 from each side of the cards. Buttons 311 are attached to the inside of flap 314*a* and to the region 315 adjacent flap 314*a* so that cards 313 are exposed for an infant to view when flap 314*a* is in an upright position, and hidden when flap 314*a* is folded. Cards may be readily exchanged without removing any buttons.

Superstructure 328 has a canopy 327 attached to and spanning two legs 328*a* and 328*b* of the superstructure. Canopy 327 is flexible and made of fabric or plastic. Canopy 327 has a flexible, transparent window 332 that defines a pocket, similar to the transparent windows of the infant play mat in FIG. 3. The transparent window is on the underside of the canopy. Canopy 327 is positioned over play area 330 so as to display a card 313 to an infant lying face up on the mat. Canopy 327 may also be configured with different means to releasably hold one or more visual stimulation cards in a non-horizontal position, such as buttons or other border clamps, touch fasteners, or elastic bands.

Figure 5:
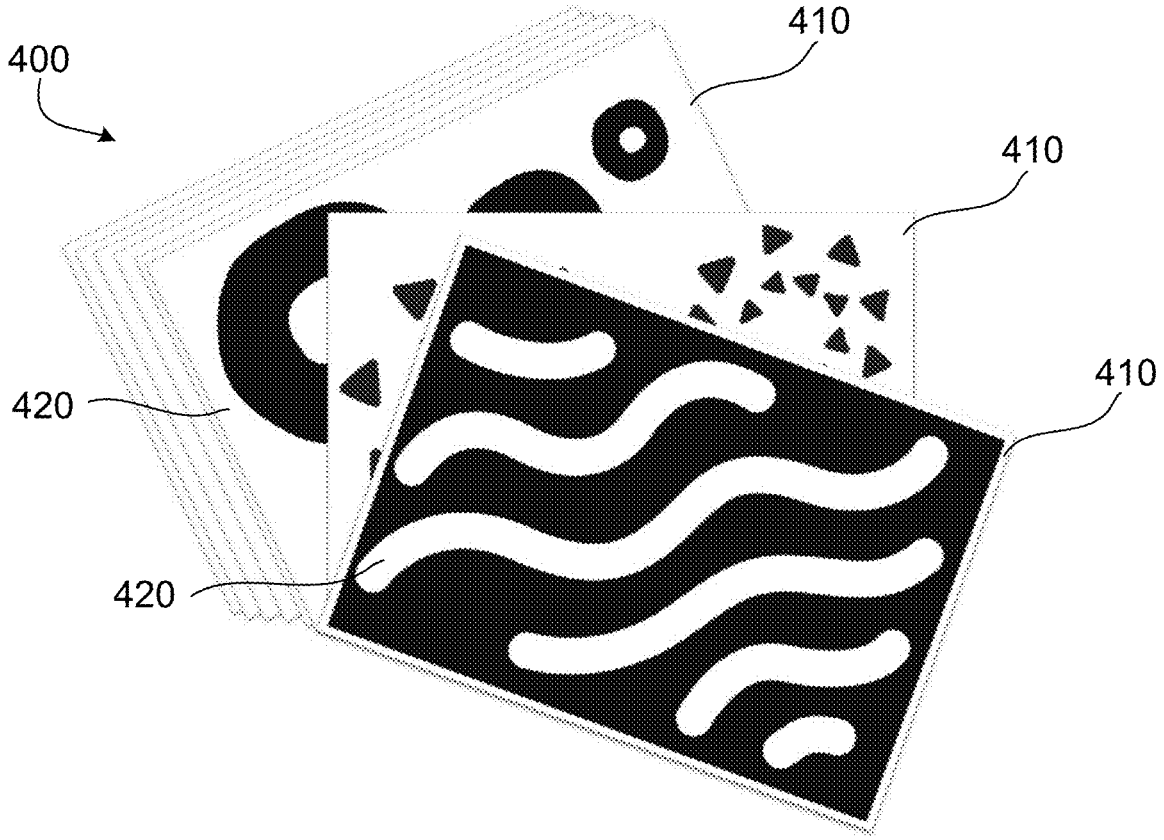
FIG. 5 shows a set of visual stimulation cards carrying different two-dimensional visual stimulation graphics.

FIG. 5 shows a set 400 of visual stimulation cards 410 carrying different two-dimensional visual stimulation graphics 420 and selectably and alternately attachable to any of the card holders described above, for display to an infant lying in the infant play area. The cards may be formed of thick card stock or plastic, for example, and may be embossed, painted, printed or otherwise provided with visually different graphics, either black/white or color. Some cards may carry images or photos of family members or scenes.

While a number of examples have been described for illustration purposes, the foregoing description is not intended to limit the scope of the invention, which is defined by the scope of the appended claims. There are and will be other examples and modifications within the scope of the following claims.

What is claimed is:

1. An infant play mat comprising:

a flexible central mat portion having a fabric surface forming a first infant play area and having a perimeter comprising multiple straight edges, two of the edges defining a corner therebetween;

multiple flexible flaps, each flap extending from a respective one of the central mat portion straight perimeter edges that defines a first fold line of reduced folding stiffness, each flap having an upper flap surface exposed when the flap is extended to be co-planar with the central mat portion, and hidden when the play mat is folded at the first fold line to cover a region of the central mat portion with the flap and expose a lower surface of the flap; and an internal flap extending from a second fold line of reduced folding stiffness and internal to the first infant play area, the internal flap comprising an upper flap surface hidden when the internal flap is folded at its second fold line to cover a region of the central mat portion with the flap and expose a lower surface of the internal flap;

wherein the central mat portion and lower surfaces of the flaps together form a second infant play area when the play mat is folded at all of the fold lines; and wherein two of the flaps extend from the two edges defining the corner and are shaped such that when overlaying the central mat portion the two flaps do not overlap.

2. The play mat of claim 1, wherein all of the flaps are shaped such that, with the play mat folded at all of the fold lines, none of the flaps overlap.

3. The play mat of claim 1, wherein the two flaps that extend from the two edges have outer edges that lie adjacent to one another with the two flaps overlaying the central mat portion.

4. The play mat of claim 1, wherein the two flaps that extend from the two edges both extend to the corner.

5. The play mat of claim 1, further comprising a superstructure support leg extending from the perimeter, the second fold line attached to the central mat portion and the internal flap of sufficient width to be propped against the support leg in an elevated flap position when the internal flap is extended to expose an upper flap surface of the internal flap.

6. The play mat of claim 5, wherein the internal flap has an outer edge that aligns with a portion of one of the straight edges of the perimeter, when the internal flap is in a folded position.

7. The play mat of claim 5, wherein the superstructure support leg extends from a superstructure comprising legs extending from the perimeter of the central mat portion and connected at a point spaced above the central mat portion.

8. The play mat of claim 7, further comprising at least one item suspended on a cord from the superstructure over the central mat portion.

9. The play mat of claim 1, wherein the central mat portion carries an image boundary aligned with an outer edge of a flap with the play mat folded.

10. The play mat of claim 9, wherein the boundary is of an image that extends from the boundary to an adjacent edge of the perimeter, such that the play mat is foldable to hide the image.

11. The play mat of claim 9, wherein the central mat portion carries multiple image boundaries, each boundary aligned with an outer edge of a respective flap with the play mat folded.

12. The play mat of claim 11, wherein each of the multiple image boundaries bounds an image extending from the boundary to a respective adjacent edge of the perimeter.

13. An infant play mat comprising:

a flexible central mat portion having a fabric surface forming a first infant play area and having a perimeter comprising a straight edge;

a flexible flap extending from the central mat portion straight perimeter edge that defines a first fold line of reduced folding stiffness, the flap having an upper flap surface exposed when the flap is extended to be co-planar with the central mat portion, and hidden when the play mat is folded at the first fold line to cover a region of the central mat portion with the flap and expose a lower surface of the flap; and an internal flap extending from a second fold line of reduced folding stiffness and internal to the first infant play area, the internal flap comprising an upper flap surface hidden when the internal flap is folded at its second fold line to cover a region of the central mat portion with the flap and expose a lower surface of the internal flap;

wherein the central mat portion and lower surface of the flexible flap together form a second infant play area when the play mat is folded at all of the fold lines.

14. The infant play mat of claim 13, wherein the internal flap comprises a card holder comprising means to releasably hold a visual stimulation card in view of an infant lying in the first infant play area.

15. The infant play mat of claim 14, wherein the means to releasably hold a visual stimulation card comprises a transparent window overlying a pocket sized to receive the stimulation card.

16. The infant play mat of claim 14, wherein the second fold line extends from one outer edge of the perimeter to another outer edge of the perimeter.

17. The infant play mat of claim 13, further comprising a superstructure comprising multiple legs extending upward from the perimeter of the central mat portion and connected above the central mat portion.

18. The infant play mat of claim 17, wherein a first leg of the superstructure extends from a portion of the perimeter outboard of the internal flap.

19. The infant play mat of claim 18, wherein the internal flap is configured to engage and be supported by the first leg in an open position.

* * * * *